US010117527B2

(12) United States Patent
Johnson et al.

(10) Patent No.: US 10,117,527 B2
(45) Date of Patent: Nov. 6, 2018

(54) STRING LIGHT RETAIL DISPLAY UNIT

(71) Applicant: Target Brands, Inc., Minneapolis, MN (US)

(72) Inventors: Jason W. Johnson, Wayzata, MN (US); Erin L. Zobel, Minneapolis, MN (US); Christopher A. Hammond, Edina, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 15/414,730

(22) Filed: Jan. 25, 2017

(65) Prior Publication Data

US 2018/0206656 A1 Jul. 26, 2018

(51) Int. Cl.

| | |
|---|---|
| ***B65D 85/38*** | (2006.01) |
| ***A47F 3/14*** | (2006.01) |
| ***B65B 63/04*** | (2006.01) |

(52) U.S. Cl.

CPC ..... *A47F 3/147* (2013.01); *B65B 63/04* (2013.01)

(58) Field of Classification Search

CPC ..... B65B 63/04; B65D 59/04; B65D 71/50; B65D 85/38

USPC ..... 206/420, 419, 394

See application file for complete search history.

(56) References Cited

U.S. PATENT DOCUMENTS

| | | | | |
|---|---|---|---|---|
| D244,259 | S | 5/1977 | Bergstein | |
| 4,291,803 | A | 9/1981 | Perales | |
| 4,979,085 | A | 12/1990 | Voorhees | |
| 5,168,999 | A | 12/1992 | Lee et al. | |
| 5,228,569 | A | 7/1993 | House | |
| 5,381,899 | A | 1/1995 | Rabbitt | |
| D362,158 | S | 9/1995 | Smith et al. | |
| 6,059,110 | A | 5/2000 | Tseng | |
| 6,648,132 | B1 * | 11/2003 | Smouha | A45C 11/12 206/301 |
| 6,926,145 | B2 * | 8/2005 | Bartlett | B65H 49/38 206/420 |
| 6,971,513 | B2 | 12/2005 | Weinstein et al. | |
| 7,004,319 | B2 | 2/2006 | Knight et al. | |
| 7,210,818 | B2 | 5/2007 | Luk et al. | |
| 7,600,895 | B2 | 10/2009 | Hawkins et al. | |
| 7,665,612 | B2 | 2/2010 | Turner | |
| 8,573,429 | B2 | 11/2013 | Hawkins | |
| 9,215,939 | B2 | 12/2015 | Zobel et al. | |
| D751,817 | S | 3/2016 | Stuart et al. | |
| 2016/0075473 | A1 | 3/2016 | Stuart et al. | |

* cited by examiner

*Primary Examiner* — King M Chu

(74) *Attorney, Agent, or Firm* — Leanne Taveggia Farrell; Westman, Champlin & Koehler, P.A.

(57) ABSTRACT

A retail display unit includes a plurality of clear tubes positioned substantially adjacent to each other and each having a length. A plurality of clear inserts each positioned inside one of the plurality of clear tubes and extend the length of the one of the plurality of clear tubes. Each clear insert includes a first end that corresponds with a first end of each clear tube and an opposing second end that corresponds with an opposing second end of each clear tube. A plurality of strings of lights are continuously wrapped around and engaged with the first and second ends of the plurality of clear inserts.

18 Claims, 8 Drawing Sheets

STRING LIGHT RETAIL DISPLAY UNIT

BACKGROUND

Retail stores use a variety of display fixtures to present products to customers for purchase. These display fixtures can support the product, indicate the product price, include signage for highlighting the product and/or include structures that hold samples of the product. Exemplary display structures include shelves, trays, racks, peg hooks and other similar structures.

The discussion above is merely provided for general background information and is not intended to be used as an aid in determining the scope of the claimed subject matter.

SUMMARY

A retail display unit includes a plurality of clear tubes, a plurality of clear inserts and a plurality of strings of lights. The plurality of clear tubes are positioned substantially adjacent to each other and each have a length. The plurality of clear inserts are each positioned inside one of the plurality of clear tubes and extend the length of each of the plurality of clear tubes. Each clear insert includes a first end that corresponds with a first end of each clear tube and an opposing second end that corresponds with an opposing second end of each clear tube. The plurality of strings of lights are continuously wrapped around and engaged with the first and second ends of the plurality of clear inserts.

A retail display unit includes a shell having a first flange, a back wall and a second flange. The first flange includes at least one circular cutout. At least one transparent tube extends between the second flange and the first flange and is located through the circular cutout in the first flange. At least one transparent insert is positioned inside the transparent tube and extends a length of the transparent tube. The transparent insert includes a first end that corresponds with a first end of the transparent tube and an opposing second end that corresponds with an opposing second end of the transparent tube. A string of lights is continuously wrapped around and engaged with the first and second ends of the clear insert.

A method of replacing a string of lights in a string light retail display unit includes removing a clear insert through a first end of one of a plurality of clear tubes positioned substantially adjacent to each other. The string of lights is wrapped around first and second ends of the clear insert. The string of lights is unwound from the clear insert. A replacement string of lights is wrapped around the first and second ends of the clear insert. The clear insert is positioned back through the first end of the one of the plurality of clear tubes so that the clear insert is positioned in the one of the plurality of clear tubes.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The retail display unit described herein provides a dramatic presentation of string lights being offered for sale in a retail store. A plurality of vertically oriented and transparent or clear tubes are placed adjacent to each other or side-by-side and each contain a lit sample string of lights. Each sample string of lights is wrapped around a transparent or clear insert that is located inside one of the tubes. The insert provides a consistent, organized wrap of a string of lights, but appears from the exterior to be a grouping of jumbled lights. The insert also provides store personnel with an easy method of replacing a strand of lights in a tube.

Figure 1:
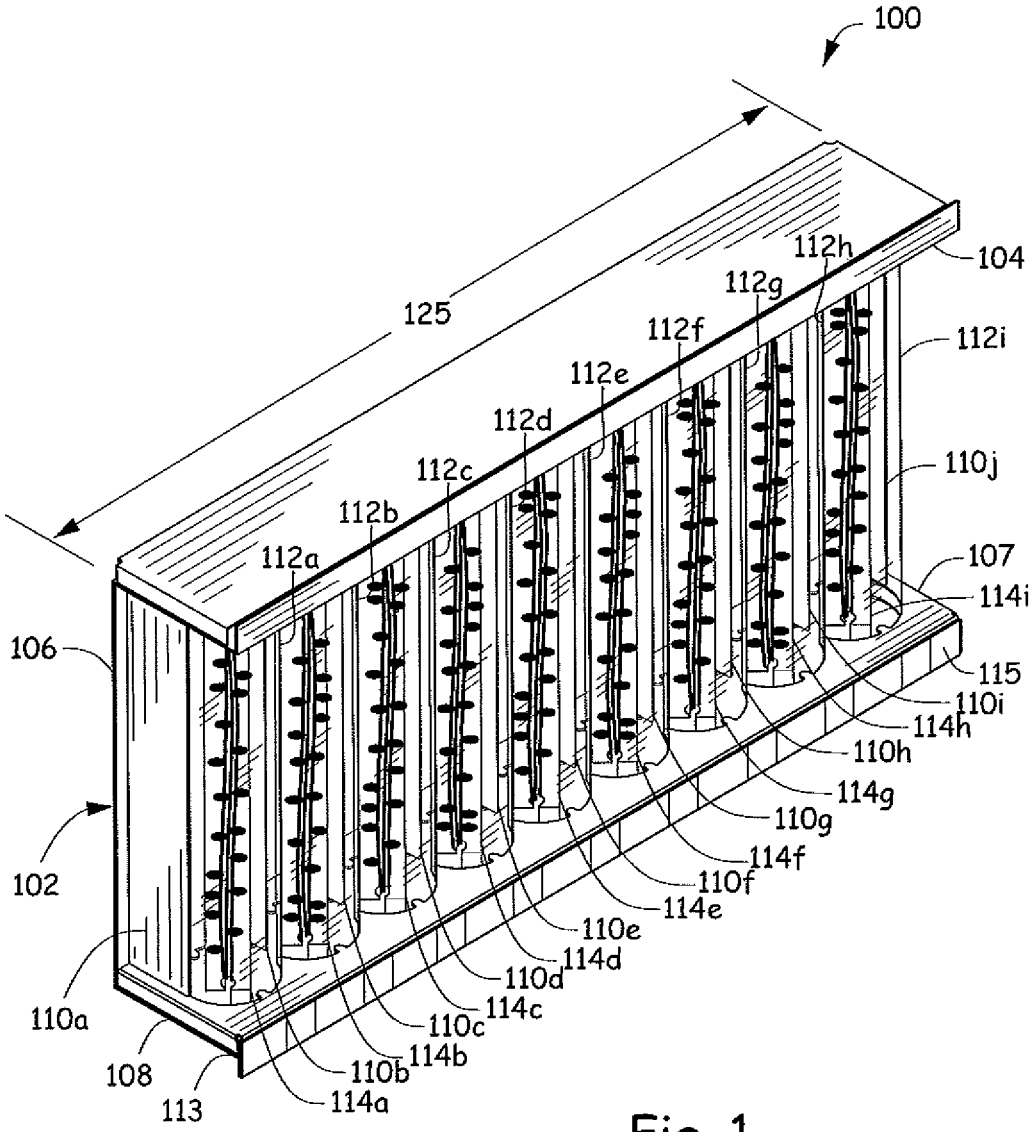
FIG. 1 is a perspective view of a retail display unit including a plurality of strings of lights on display according to one embodiment.
Figure 2:
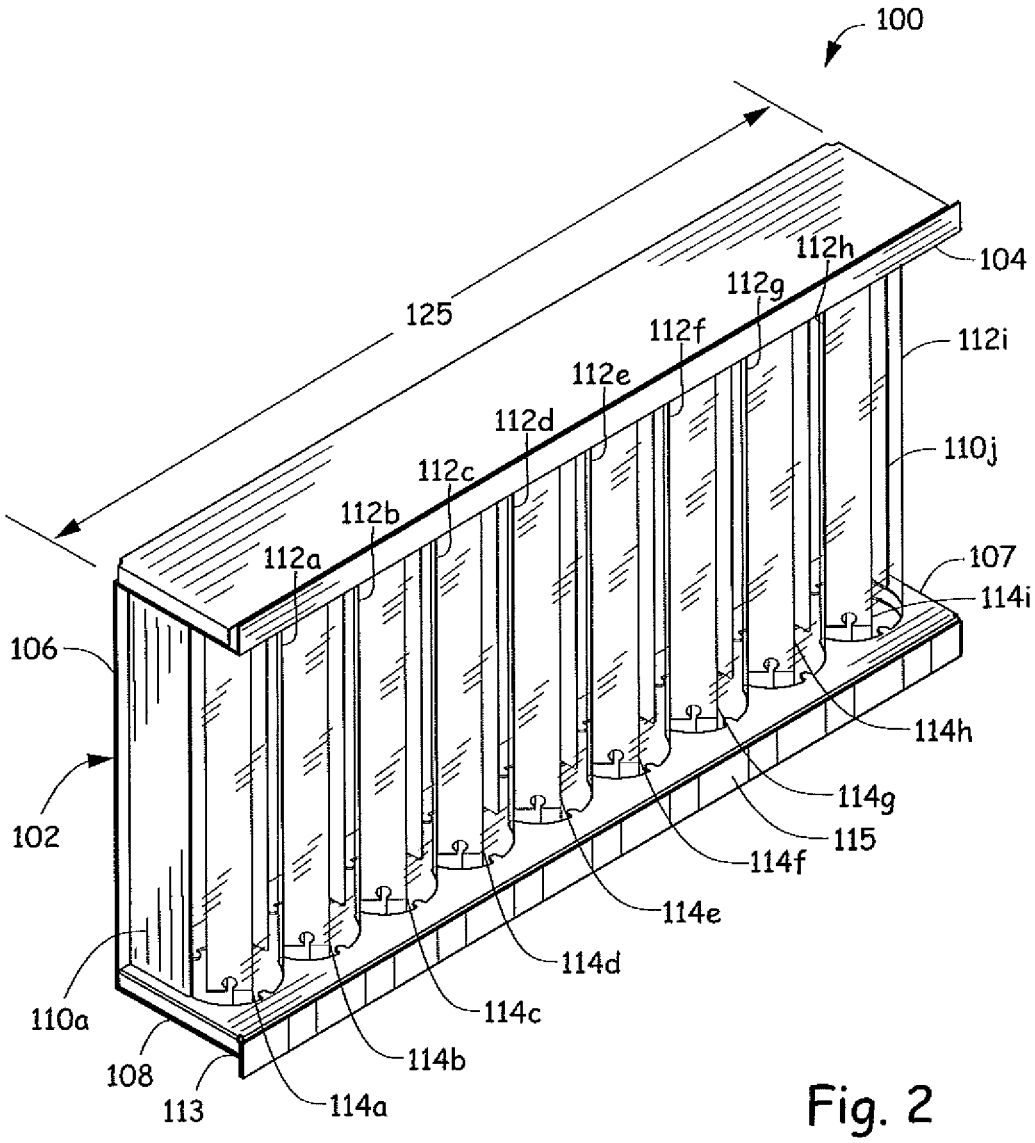
FIG. 2 is the perspective view of FIG. 1, but with the plurality of strings of lights removed.
Figure 3:
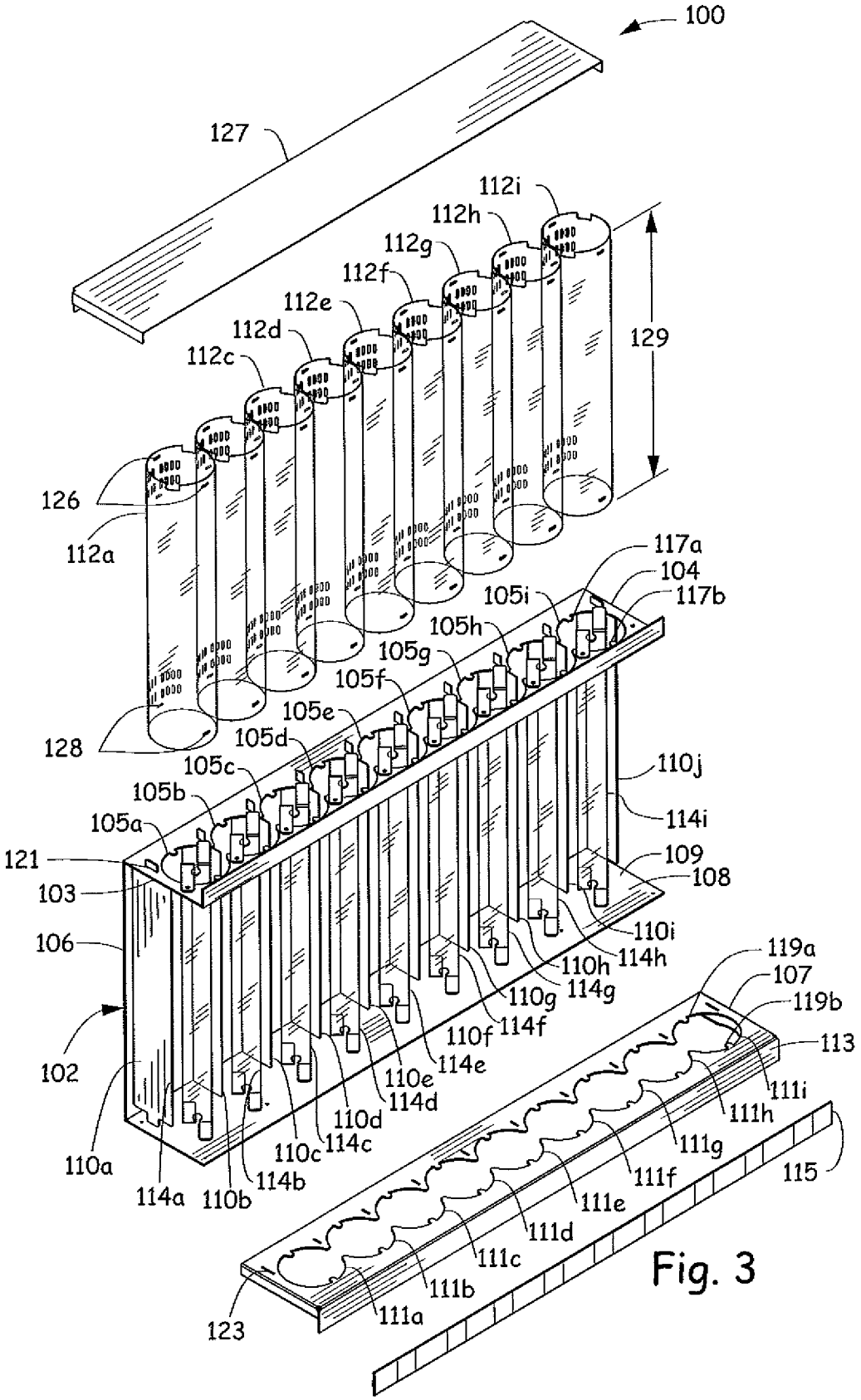
FIG. 3 is an exploded view of the retail display unit illustrated in FIG. 2.
Figure 4:
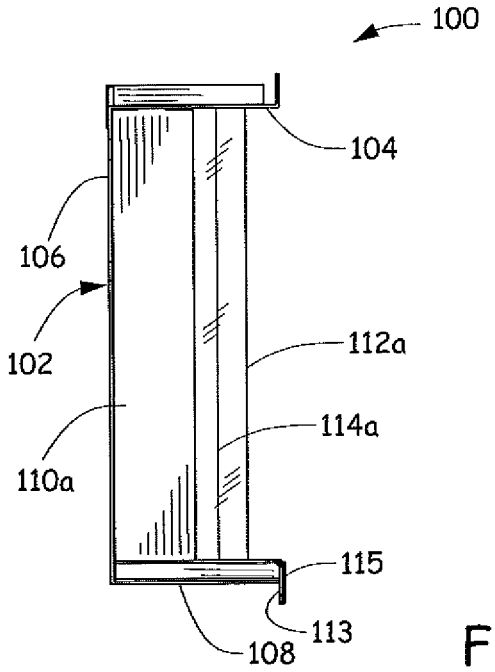
FIG. 4 is a left side view of the retail display unit illustrated in FIG. 2.
Figure 5:
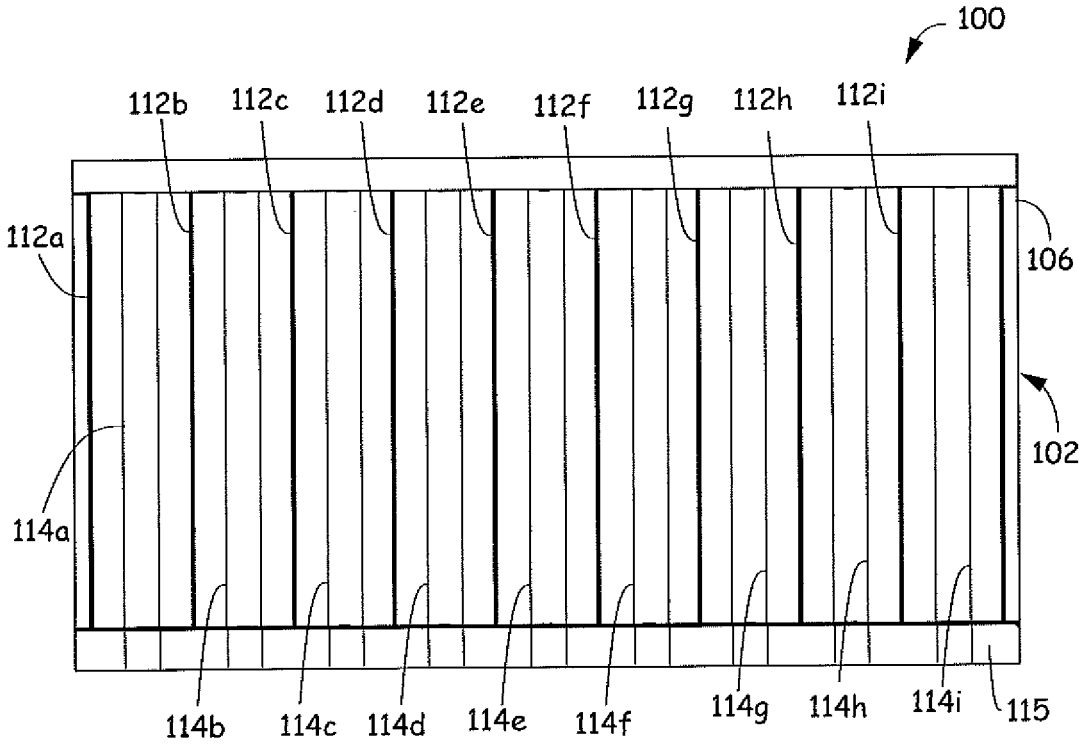
FIG. 5 is a front view of the retail display unit illustrated in FIG. 2.

FIG. 1 is a perspective view of retail display unit 100 including a plurality of strings of lights on display according to one embodiment. FIG. 2 is the perspective view of retail display unit 100, but with the plurality of strings of lights removed. FIG. 3 is an exploded view of retail display unit 100 illustrated in FIG. 2, FIG. 4 is a left side view of retail display unit 100 illustrated in FIG. 2 and FIG. 5 is a front view of retail display unit 100 illustrated in FIG. 2.

Retail display unit 100 includes a shell 102 having a first or upper flange 104 with a plurality of circular cutouts 105*a-i* (FIG. 3) that extend through the entirety of first or upper flange 104 from a first or upper surface to a second or lower surface, a back panel 106 and a second or bottom flange 108. Shell 102 (and other structural components of retail display unit 100) can be made of many types of materials including polystyrene, such as a high impact polystyrene (HIPS), and the like. Both upper flange 104 and bottom flange 108 extend forward in a substantially horizontal plane from back panel 106, which is in a substantially vertical plane. Retail display unit 100 also includes a base 107. Like first or upper flange 104, base 107 includes a plurality of circular cutouts 111*a-i* that extend through the entirety of base 107 from a first or upper surface to a second or lower surface. Base 107 further includes a front panel 113 configured to receive a front label 115. As illustrated in FIGS. 1 and 2, base 107 is positioned or located on the first or upper surface of bottom flange 108 so that the plurality of circular cutouts 111*a-i* in base 107 are aligned with the plurality of circular cutouts 105*a-i* in upper flange 104.

As illustrated in FIG. 3, each circular cutout 105*a-i* and 111*a-i* includes a pair of projections 117*a*, 117*b*, 119*a* and 119*b*. Pair of projections 117*a* and 117*b* protrude into their respective cutouts 105*a-i* on opposing sides from each other (projections 117*a* and 117*b* are called out in circular cutout 105*i* in FIG. 3). Pair of projections 119*a* and 119*b* protrude into their respective cutouts 111*a-i* on opposing sides from each other (projections 119*a* and 119*b* are called out in circular cutout 111*i* in FIG. 3). Projections 117*a* and 117*b* and 119*a* and 119*b* will be discussed in more detail below.

Figure 6:
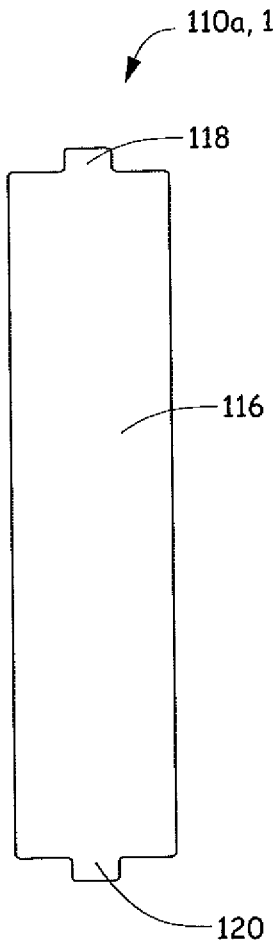
FIG. 6 illustrates a plan view of an end divider of the retail display unit in FIGS. 1 and 2 according to one embodiment.
Figure 7:
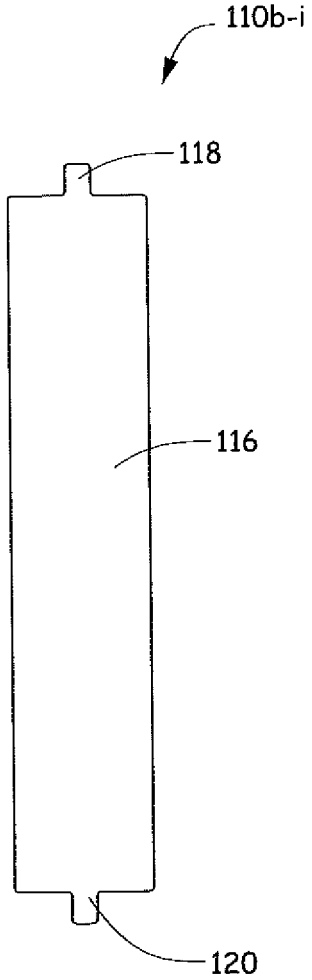
FIG. 7 illustrates a plan view of a middle divider of the retail display unit according to one embodiment.

Retail display unit 100 further includes a plurality of dividers 110*a-j*, a plurality of clear or transparent tubes 112*a-i*, a plurality of clear or transparent inserts 114*a-i* and a top 127. FIG. 6 illustrates a plan view of each end divider 110*a* and 110*j* according to one embodiment. End divider 110*a* is located on the left side of retail display unit 100 and end divider 110*j* is located on the right side of retail display unit 100. In one embodiment and as illustrated, end dividers 110*a* and 110*j* are substantially identical to each other. FIG. 7 illustrates a plan view of each middle divider 110*b-i* according to one embodiment. In one embodiment and as illustrated, middle dividers 110*b-i* are all substantially identical. Each of dividers 110*a-j*, including end dividers 110*a* and 110*j* and middle dividers 110*b-i*, has a main body 116, a first end or upper tab 118 that extends upwardly from main body 116 and a second end or lower tab 120 that extends downwardly from main body 116. As illustrated in FIGS. 1-3, all dividers 110*a-j* are spaced apart from each other along a length 125 of retail display unit 100 with main bodies 116 of dividers 110*a-j* extending between a bottom surface 103 of upper flange 104 and a top surface 109 of bottom flange 108. In addition, first end or upper tabs 118 of each divider 110*a-j* are located in slots 121 (one slot is called out in FIG. 3) that extend through first or upper flange 104 and first end or lower tabs 120 are located in slots 123 (one slot is called out in FIG. 3) that extend through second or bottom flange 108 so that dividers 110*a-j* remain secured in place.

In between each divider 110*a-j* includes one of a plurality of transparent or clear tubes that are positioned substantially adjacent to each other. In one embodiment and as illustrated, clear tubes 112*a-i* are all substantially identical including having a substantially identical length 129. For example, in one embodiment and as illustrated, length 129 can be approximately 23.5 inches, however, other lengths are possible. In one embodiment, each clear tube 112*a-i* is made of a cold-formed clear PETG (polyethylene terephthalate glycol). In particular, each clear tube is made of a flat sheet of clear PETG that is bent into a circle and seamed in the back. Such material provides better surface clarity compared to other stock clear or transparent extruded tubing. More specifically, tube 112*a* is located between dividers 110*a* and 110*b*, tube 112*b* is located between dividers 110*b* and 110*c*, tube 112*c* is located between dividers 110*c* and 110*d*, tube 112*d* is located between dividers 110*d* and 110*e*, tube 112*e* is located between dividers 110*e* and 110*f*, tube 112*f* is located between dividers 110*f* and 110*g*, tube 112*f* is located between dividers 110*f* and 110*g*, tube 112*g* is located between dividers 110*g* and 110*h*, tube 112*h* is located between dividers 110*h* and 110*i* and tube 112*i* is located between dividers 110*i* and 110*j*.

Figure 8:
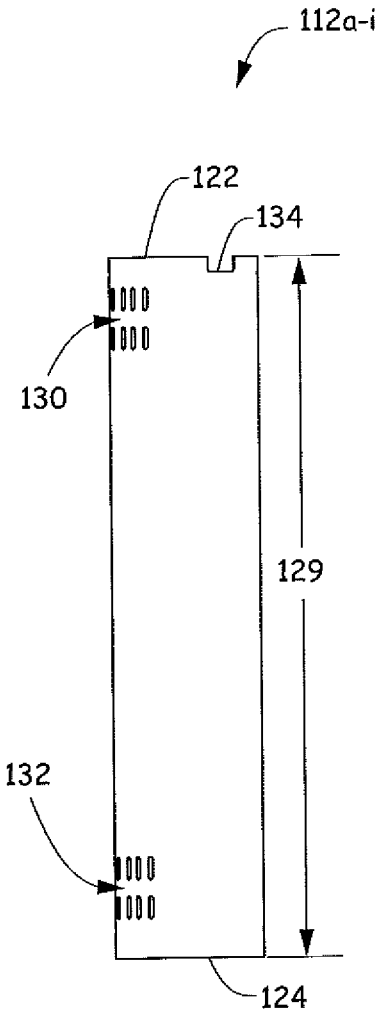
FIG. 8 illustrates a left side view of a clear tube of the retail display unit in FIGS. 1 and 2 according to one embodiment.
Figure 9:
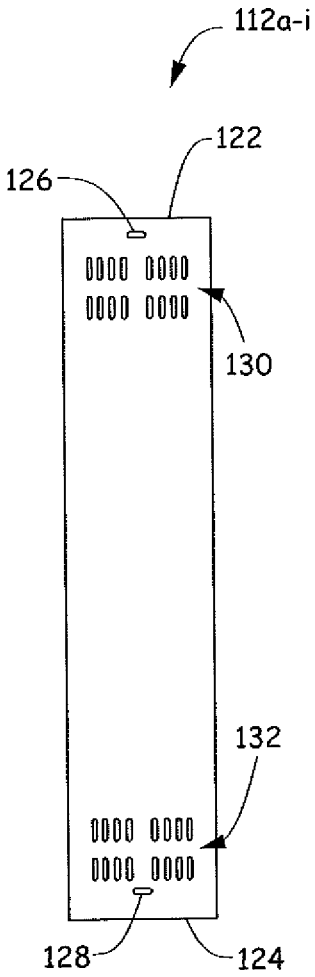
FIG. 9 illustrates a back view of the clear tube in FIG. 8.

FIG. 8 illustrates a left side view of a clear tube 112*a-i* of retail display unit 100. FIG. 9 illustrates a back view of clear tube 112*a-i* of retail display unit 100. Each clear tube 112*a-i* includes a first or top end 122, a second or bottom end 124, a pair of first end or upper mounting slots 126 (both are called out in clear tube 112*a* in FIG. 3), a pair of second end or lower mounting slots 128 (both are called out in clear tube 112*a* in FIG. 3), a plurality of first end or upper apertures 130, a plurality of second end or lower apertures 132 and a pair of first end or upper notches 134.

With reference to FIGS. 1 and 2, where tubes 112*a-i* are part of or assembled in retail display unit 100, and FIG. 3, where tubes 112*a-i* are in an exploded view, each of tubes 112*a-i* is positioned through one of plurality of circular cutouts 105*a-i* in first or upper flange 104 and positioned through one of circular cutouts 111*a-i* in base 107, which is positioned on second or lower flange 108, so that each tube 112*a-i* extends between first or upper flange 104 and second or lower flange 108. Each tube 112*a-i* engages with first or upper flange 104 by each pair of projections 117*a* and 117*b* being inserted through one of the pair of first end or upper mounting slots 126 in each tube 112*a-i*. Likewise, each tube 112*a-i* engages with base 107 located on second or bottom flange 108 by each pair of projections 119*a* and 119*b* being inserted through one of the pair of second end or lower mounting slots 128.

Figure 10:
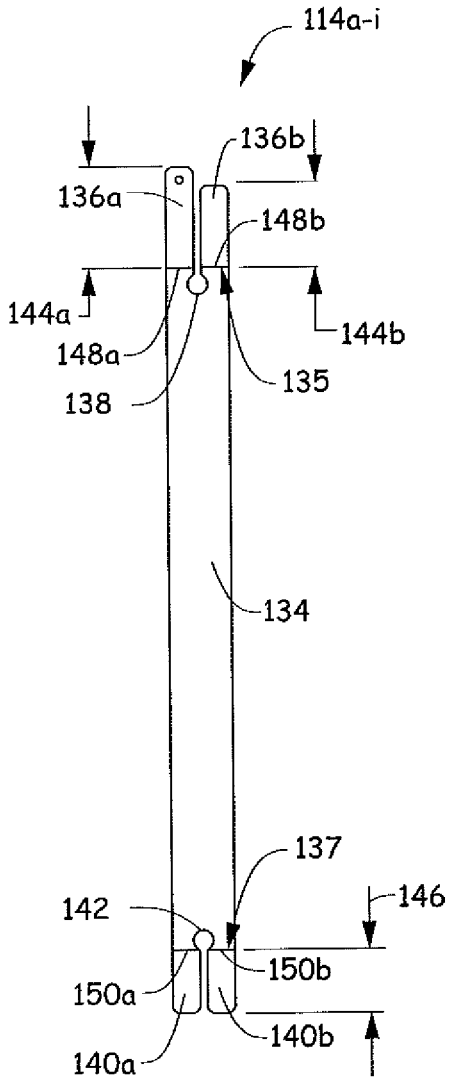
FIG. 10 is a plan view of an insert of the retail display unit in FIGS. 1 and 2 in an unbent configuration according to one embodiment.
Figure 11:
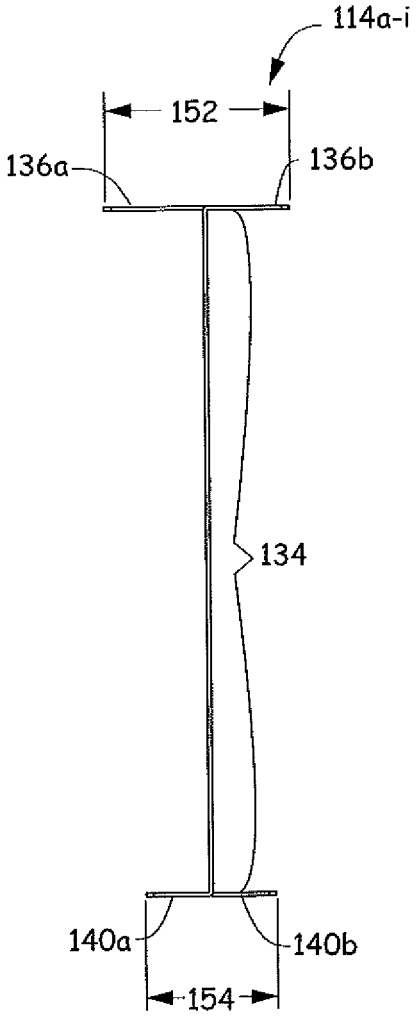
FIG. 11 is an end view of the insert illustrated in FIG. 10 in a bent configuration according to one embodiment.

FIG. 10 illustrates a plan view of a clear or transparent insert 114*a-i* of retail display unit 100 with insert 114*a-i* in an unbent configuration. FIG. 11 illustrates a side view of the insert 114*a-i* of retail display unit 100 in a bent configuration. Each insert 114*a-i* includes a main body 134, a first or upper end 135 and a second or lower end 137, two first end or upper prongs 136*a* and 136*b*, two second end or lower prongs 140*a* and 140*b*, a first or upper notch 138 and a second or lower notch 142. In one embodiment and as illustrated, main body 134 has a length that is approximately 22⅞ inches. First or upper notch 138 intersects with first end 135 and extends from first end 135 into main body 134. Second or lower notch 142 intersects with second end 137 into main body 134. Two first end or upper prongs 136*a* and 136*b* extend from first end 135 with the intersection of first notch 138 with first end being located there between. Two second end or lower prongs 140*a* and 140*b* extend from second end 137 with the intersection of second notch 142 with second end 137 being located there between.

As illustrated in FIG. 10, first end or upper prong 136*a* has a length 144*a* that is longer than length 144*b* of first end or upper prong 136*b*. Second end or lower prongs 140*a* and 140*b*, however, have substantially the same length 146, which is shorter than lengths 144*a* and 144*b*. As illustrated in FIG. 11 and in the bent configuration, first end or upper prongs 136*a* and 136*b* are bent at bend lines 148*a* and 148*b*, respectively, so that first end or upper prongs 136*a* and 136*b* are bent substantially 90 degrees from main body 134. Bend lines 148*a* and 148*b* are in alignment with each other along first end 135 and are configured to bend in directions opposite to each other. Likewise, second end or lower prongs 140*a* and 140*b* are bent at bend lines 150*a* and 150*b*, respectfully, so that second end or lower prongs 140*a* and 140*b* are bent substantially 90 degrees from main body 134. Bend lines 150*a* and 150*b* are in alignment with each other along second end 137 and are configured to bend in directions opposite to each other. Because of lower prongs 140*a* and 140*b* being shorter in length than upper prongs 136*a* and 136*b*, together a span 152 of upper prongs 136*a* and 136*b* is greater than a span 154 of lower prongs 140*a* and 140*b*.

In one embodiment and as illustrated in FIG. 10, notches 138 and 142 of inserts 114*a-i* have a circular shape and are for engaging with and holding a string of lights. As illustrated in FIG. 1, a string of lights is continuously wrapped around the lengthwise dimension of each insert 114*a-i* between first end or upper notch 138 and second end or lower notch 142 before each insert 114*a-i* is positioned inside or inserted into one of clear tubes 112*a-i* and extend length 129 of each clear tube 112*a-i*. In one embodiment and as illustrated in FIG. 1, each string of lights is wrapped twice around the length of main body 134 of each clear insert. However, other amounts are possible depending up on the length of the string. Therefore, each first end 135 of each clear insert corresponds with first end 122 of each clear tube 112*a-i* and each second end 137 of each clear insert 114*a-i* corresponds with second end 124 of each clear tube 112*a-i*.

As illustrated in FIG. 3, span 154 of second end or lower prongs 140*a* and 140*b* of each insert 114*a-i* is small enough to fit inside an inner diameter of each tube 112*a-i*. Second end or lower prongs 140*a* and 140*b* are positioned on and rest on top surface 109 of second or bottom flange 108. As also illustrated in FIG. 3, span 152 of upper prongs 136*a* and 136*b* of each insert 114*a-i* is large enough that upper prongs 136*a* and 136*b* extend outside a diameter of each circular cutout 105*a-i* in first or upper flange 104. In addition, a portion of each of first end or upper prongs 136*a* and 136*b* will align with and rest in one of the pair of first end or upper notches in each tube 112*a-i*. This engagement of first end or upper prongs 136*a* and 136*b* of each insert 114*a-i* with one of the tubes 112*a-i* and the engagement of each tube 112*a-i* with base 107 and upper flange 104 secures each clear insert 114*a-i* in retail display unit 100.

With strings of lights wrapped around clear inserts 114*a-i* and positioned inside clear tubes 112*a-i*, dividers 110*a-j* not only provide structural integrity to shell 102, but also may be black in color so as to isolate each color/bulb type in each clear tube 112*a-i* and prevent the "bleeding" of neighboring lights. In addition, apertures 130 and 132 in clear tubes 112*a-i* provide vents or a path of convective airflow inside each clear tube 112*a-i* in case the temperature of the lights gets too warm. In one embodiment, apertures 130 and 132 are precautionary when the string lights comprise LED lights. In general, LED lights run cool.

Figure 12:
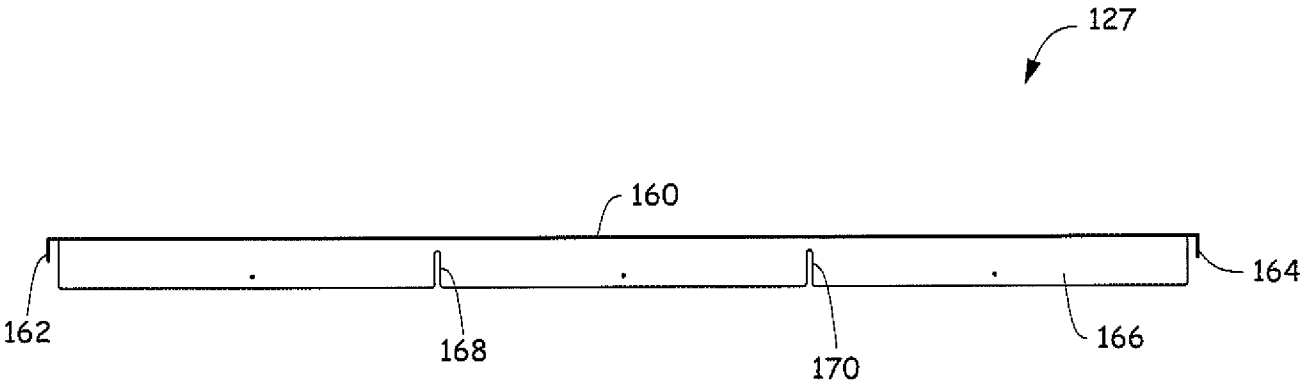
FIG. 12 illustrates a front view of a top of the retail display unit in FIGS. 1-3 according to one embodiment.

FIG. 12 illustrates a front view of top 127 of retail display unit 100 according to one embodiment. Top 127 includes an upper flange 160 that is oriented substantially horizontal, side flanges 162 and 164 and back flange 166. Side flanges 162 and 164 and back flange 166 extend downwardly from upper flange 160. Together upper flange 160, side flanges 162 and 164 and back flange 166 enclose the top of retail display fixture 100 so as to hide the upper portions.

Back flange 166 of top 127 further includes a pair of slots 168 and 170 that intersect with the bottom edge of back flange and terminate at a point that is a distance less than the height of back flange 166. Slot 168 is spaced apart from the left side of back flange 166, but in closer proximity to left side flange 162 than right side flange 164. Slot 170 is spaced apart from a right side of back flange 166, but in closer proximity to right side flange 164 than left side flange 162. Pair of slots 168 and 170 provide a routing for string light cords to move from the inside shell 102 to the outside of shelf 102 so as to connect to a power source. Although not specifically illustrated in the figures, in one embodiment, retail display unit 100 includes a power strip that is mounted to the back of back panel 106 of shell 102, for example by using adhesive tape. In addition, multiple strings of lights from located in the clear tubes can be plugged into each other to form a series. The cord and power plugs from these series of strings of lights are fed out through slots 168 and 170 to the power strip mounted on the back of back panel 106.

When each insert 114*a-i* holding a wrapping of a string of lights is inserted into each of tubes 112*a-i*, the string of lights appear to take on a jumbled light effect even though the lights are being held by one of the clear inserts 114*a-i* in an organized fashion. The entire retail display unit 100 can be secured to and displayed on a retail shelf or other support structure and easily viewed by customers in a retail store. If any of the strings of lights in any of the clear tubes 112*a-i* need to be swapped out for a different string of lights, this is easily done. The select clear insert 114*a-i* that holds the string of lights that needs replacing is unplugged and removed from its clear tube 112*a-i* through the first end or top 122 of one of the clear tubes 112*a-i*. The string of lights is unwound from clear insert 114*a-i*. A different string of lights or replacement string of lights is wrapped around the first and second ends of clear insert 114*a-i*. The clear insert 114*a-i* is positioned back into tube 112*a-i* so that the clear insert is again positioned inside the clear tube and also plugged in.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A retail display unit comprising:

a plurality of clear tubes positioned substantially adjacent to each other and each having a length;

a plurality of clear inserts each positioned inside one of the plurality of clear tubes and extending the length of the one of the plurality of clear tubes, wherein each clear insert includes a first end that corresponds with a first end of each clear tube and an opposing second end that corresponds with an opposing second end of each clear tube; and a plurality of strings of lights continuously wrapped around and engaged with the first and second ends of the plurality of clear inserts;

wherein each clear insert comprises a first notch and a second notch, the first notch intersects with the first end of the clear inserts and extends from the first end of the clear insert into a main body of the clear insert and the second notch intersects with the second end of the clear insert and extends from the second end of the clear insert into the main body, wherein the first and second notches engage with the string of lights wrapped around the clear insert.

2. The retail display unit of claim 1, further comprising a shell having a first flange with a plurality of circular cutouts that extend entirely through the first flange, a back panel and a second flange, wherein each of the plurality of clear tubes are positioned between the second flange and through one of the plurality of circular cutouts in the first flange.

3. The retail display unit of claim 2, further comprising a base having a plurality of circular cutouts that extend entirely through the base and being located on the second flange so that each of the plurality of circular cutouts in the first flange align with each of the plurality of circular cutouts in the base, wherein each of the plurality of clear tubes are positioned through one of the plurality of circular cutouts in the base.

4. The retail display unit of claim 3, wherein each of the plurality of circular cutouts in the first flange and each of the plurality of circular cutouts in the base comprise a respective pair of projections that protrude into the their respective circular cutout, wherein each projection is inserted through one of a pair of first end mounting slots or one of a pair of second end mounting slots that extend through each of the clear tubes to secure each clear tube to the first flange and the base.

5. The retail display unit of claim 3, further comprising a plurality of dividers spaced apart from each other along a length of the retail display unit, wherein each divider extends from a first end tab that is inserted through one of a plurality of slots in the first flange and a second end tab that is inserted through one of a plurality of slots in the base.

6. The retail display unit of claim 1, wherein each of the first and second notches of each clear insert are at least partially circular.

7. The retail display unit of claim 1, wherein each clear insert comprises two first end prongs extending from the first end with a portion of the first notch that intersects with the first end being located there between and two second end prongs extending from the second end with a portion of the second notch that intersects with the second end being located there between, wherein each of the first end prongs and the second end prongs are bent substantially 90 degrees from a main body of each clear insert.

8. The retail display unit of claim 7, wherein the first end prongs are longer in length than the second end prongs so that a span of the second end prongs when bent fits inside an inner diameter of each of the clear tubes and a span of the first end prongs when bent allows the first end prongs to rest on a pair of first end notches located at the first ends of each of the plurality of clear tubes.

9. A retail display unit comprising:

a shell having an first flange, a back wall and a second flange, wherein the first flange includes at least one circular cutout;

at least one transparent tube extending between the second flange and the first flange, wherein the transparent tube is located through the circular cutout in the first flange;

at least one transparent insert positioned inside the transparent tube and extending a length of the transparent tube, wherein the transparent insert includes a first end that corresponds with a first end of the transparent tube and an opposing second end that corresponds with an opposing second end of the transparent tube; and a string of lights continuously wrapped around and engaged with the first and second ends of the transparent insert.

10. The retail display unit of claim 9, wherein the first flange comprises an upper flange located above the second flange and the second flange comprises a bottom flange.

11. The retail display unit of claim 9, further comprising a base having at least one circular cutout and being positioned on the second flange so that the transparent tube is located through the circular cutout in the base.

12. The retail display unit of claim 9, wherein each transparent insert comprises a first notch and a second notch, the first notch intersects with the first end and extends from the first end into a main body of the transparent insert and the second notch intersects with the second end and extends from the second end into the main body of the transparent insert, wherein the first and second notches engage with the string of lights wrapped lengthwise around the transparent insert.

13. The retail display unit of claim 12, wherein each of the first and second notches are at least partially circular.

14. The retail display unit of claim 12, wherein each transparent insert comprises two first end prongs extending from the first end with a portion of the first notch that intersects with the first end being located there between and two second end prongs extending from the second end with a portion of the second notch that intersects with the second end being located there between, wherein each of the first end prongs and the second end prongs are bent substantially 90 degrees from the main body of each clear insert.

15. The retail display unit of claim 14, wherein the first end prongs are longer in length than the second end prongs so that a span of the second end prongs when bent fits inside an inner diameter of each of the transparent tubes and a span of the first end prongs when bent allows the first end prongs to rest on a pair of rest on a pair of first end notches located at the first ends of each of the plurality of transparent tubes.

16. The retail display unit of claim 9, wherein the at least one transparent tube comprises a plurality of transparent tubes positioned substantially adjacent to each other, wherein the at least one transparent insert comprises a plurality of transparent inserts and wherein the at least one circular cutout in the first flange comprises a plurality of circular cutouts, each of the transparent tubes being located in one of the circular cutouts in the first flange and each of the transparent inserts positioned inside one of the transparent tubes.

17. A retail display unit comprising:

a plurality of clear tubes positioned adjacent to each other and having substantially identical first ends, second ends and lengths; and a plurality of clear inserts each located in one of the plurality of clear tubes and having a first end that corresponds with the first end of each clear tube, a second end that corresponds with the second end of each clear tube and a length that corresponds with a length of each clear tube, wherein each clear insert is configured to support a string of lights that are wrapped around the first and second ends of the clear insert;

wherein each clear insert comprises two first end prongs extending from the first end of each clear insert and two second end prongs extending from the second end of each clear insert and wherein each clear tube comprises a pair of notches located at the first end of each clear tube, the pair of notches at the first end of each clear tube receiving the first and second prongs at the first end of each clear insert.

18. The retail display unit of claim 17, wherein located between each of the two first end prongs and intersecting the first end of each clear insert comprises an upper notch and between each of the two second end prongs and intersecting the second end of each clear insert comprises a lower notch, wherein the upper and lower notches are configured to hold the string of lights that are wrapped around the first and second ends of the clear insert.

* * * * *